United States Patent [19]

Timm

[11] Patent Number: 5,012,538

[45] Date of Patent: May 7, 1991

[54] PLATFORM BED FRAME

[75] Inventor: Robert Timm, Park Forest, Ill.

[73] Assignee: Dresher, Incorporated, Bedford, Ill.

[21] Appl. No.: 429,315

[22] Filed: Oct. 31, 1989

[51] Int. Cl.[5] ..... A47C 19/00

[52] U.S. Cl. ..... 5/200.1; 5/201

[58] Field of Search ..... 5/200 R, 201, 282 R; 403/402, 403, 405.1, 231

[56] References Cited

U.S. PATENT DOCUMENTS

| | | | |
|---|---|---|---|
| Re. 29,611 | 4/1978 | Lawrence | 5/200 R |
| 2,844,215 | 7/1958 | Blank et al. | 403/403 X |
| 4,068,967 | 1/1978 | Hoodis | 403/402 |
| 4,169,294 | 10/1979 | Harris | 5/201 X |
| 4,196,484 | 4/1980 | Harris | 5/201 |
| 4,589,792 | 5/1986 | Niziol | 403/403 X |
| 4,870,711 | 10/1989 | Felix | 5/201 X |

FOREIGN PATENT DOCUMENTS

| | | | |
|---|---|---|---|
| 1139255 | 1/1969 | United Kingdom | 403/402 |

*Primary Examiner*—Gary L. Smith
*Assistant Examiner*—Michael J. Milano
*Attorney, Agent, or Firm*—Dressler, Goldsmith, Shore, Sutker & Milnamow, Ltd.

[57] ABSTRACT

A platform bed frame for a platform bed comprising side plates and end plates that are connected together at each corner of the bed frame by a connecting bracket. The connecting bracket is formed with integral projection portions that are press fit into tight engagement with corresponding apertures formed in the side plates and end plates.

9 Claims, 2 Drawing Sheets

PLATFORM BED FRAME

TECHNICAL FIELD

This invention relates to platform bed frames for platform beds, and specifically to a connecting means for securing the side plates and end plates of a platform for a platform bed together.

BACKGROUND OF THE INVENTION

For a number of years, platform beds, which consist of a mattress sitting on a platform, have been widely used in Europe but have not been widely accepted in the United States. A major reason for the popularity of these beds in Europe is that living quarters generally have much less space than is the case in the United States, and platform beds are more space-efficient than the conventional Hollywood-type beds which have almost totally dominated the United States market. Recently, there has been an upsurge of interest in the United States in platform beds, and this new founded popularity is generally attributed to apartment dwellers who must make more efficient use of space than home owners. In addition, platform beds blend well with modern furniture, and especially well with modular furniture that is popular in many apartment dwellings because it maximizes the use of floor space. Also platform beds have a number of other advantages over the conventional Hollywood beds. For example, the exposed legs of conventional Hollywood bed frames are a major cause of many household accidents, notably stubbed toes, and the like. Platform beds do not have exposed legs, and thus are not as likely to cause such accidents. And, because a platform bed does not have legs and sit on the floor, it totally encloses the floor space upon which it rests, and thus obviates the need to dust or vacuum underneath the bed.

The platform bed frame or platform of a platform bed, generally includes two side plates or panels, which are joined to transversely disposed end plates by conventional coupling members, such as screws and bolts, and the like. One problem with joining platform bed frames in this manner is that in some cases the screws and bolts are visible on the outer portion of the platform and detract from its appearance. Another problem is that screws and bolts are easily lost during shipment. Thus, it is desirable to fabricate side plates and end plates which have coupling members in a form which is not easily lost, and which are preferably secured on the side plates and end plates so that they may be shipped without any loose parts and in a condition whereby a consumer can merely slide the side plates and end plates together in a matter of minutes to form the platform bed.

Another problem with most prior art platform bed frames for platform beds, is that they have been usually designed to support only a mattress, and not the conventional box spring and mattress combination which is used on a Hollywood bed frame. When a conventional mattress is used on a platform bed frame, it is not as comfortable as the mattress box spring combination used on a Hollywood bed frame, because the box spring provides an extra amount of cushioning that increases the comfort of the conventional mattress. To overcome this problem, specially made mattresses have been designed for use on platform bed frames. However, these specially designed mattresses are not as readily available as conventional mattresses, and are generally more expensive. Moreover, potential users of platform beds may desire to use a mattress that they already own, and may be unwilling to spend extra money to purchase a specially-made mattress. Consequently, price and comfort considerations may deter some potential purchasers from buying platform beds. Thus, the availability of a platform bed frame which could support the conventional box spring and mattress combination, could alleviate this problem, and provide more people with a viable option of using platform beds with their consequent safety and utility advantages.

In U.S. Pat. No. 4,196,484, assigned to the same assignee as the present invention, a superior platform bed frame is disclosed that is capable of supporting a conventional mattress and box spring combination or a conventional mattress alone and includes connecting means to connect the side plates and the end plates without using screws and bolts extending into such members.

The platform bed frame comprises a pair of spaced parallel side plates having substantially identical dimensions. Each side plate includes a wall portion that defines an upper edge and a lower edge and is disposed generally vertically in relation to the floor. A generally horizontal upper member is integral with the upper edge of the wall portion, and a generally horizontal foot portion is integral with the lower edge of the wall portion for confronting the surface area upon which the platform is situated. The upper horizontal members may provide horizontal support for the frame portion of a box spring so that the box spring may be disposed directly on the platform bed frame.

The platform bed frame further includes a pair of end plates that are longitudinally spaced with respect to the side plates and extend perpendicularly between them so that the end plates and side plates together define a substantially rectangular platform bed base. Each end plate has substantially the same dimensions and includes an intermediate portion that defines an upper edge and a lower edge and is disposed generally vertically in relation to the floor. The end plates each have a generally horizontal upper arm portion that is integral with the upper edge of the intermediate portion, and a generally horizontal lower leg portion that is integral with the lower edge of the intermediate portion for confronting the surface upon which the platform is situated.

Connecting means is employed to detachably secure each of the end plates to each of the side plates to form a generally rectangular platform. The connecting means comprises a connecting bracket having separate pin members that are secured to the bracket, and extend downwardly from one face thereof, which are received in apertures provided along the upper horizontal surfaces of the side plates and the end plates. Each corner of the platform bed frame is assembled with a connecting bracket. The bracket may include means for securing a headboard to the platform in the form of a wall portion that is disposed generally vertically in relation to the floor. To provide additional support for the headboard, a generally triangular plate member may be secured at the corners in cooperation with downwardly extending flanges associated with the side plates and end plates.

Platform bed frames constructed in accordance with the above patent have achieved wide acceptance in the marketplace. The present invention is specifically directed to improve upon this particular bed frame design to facilitate manufacture of certain component parts and the assembly thereof and thereby reduce the cost of the bed frame.

SUMMARY OF THE INVENTION

In accordance with the present invention, the connecting bracket is formed with embossed holes extending therethrough that form integral projection portions that extend outward beyond the surface thereof that contacts the end plates and the side plates. The projection portions are located to cooperate with and extend through corresponding apertures along the upper horizontal surfaces of the end plates and the side plates. The projection portions are formed of a diameter to be press fit into in the apertures and are of a length so as to project therethrough and extend a short distance beyond the lower edges of the upper horizontal surfaces of the end plates and the side plates.

In so doing, the fabrication and assembly costs of the connecting bracket is reduced and the assembly of the platform bed frame is facilitated.

DESCRIPTION OF A PREFERRED EMBODIMENT

Figure 1:
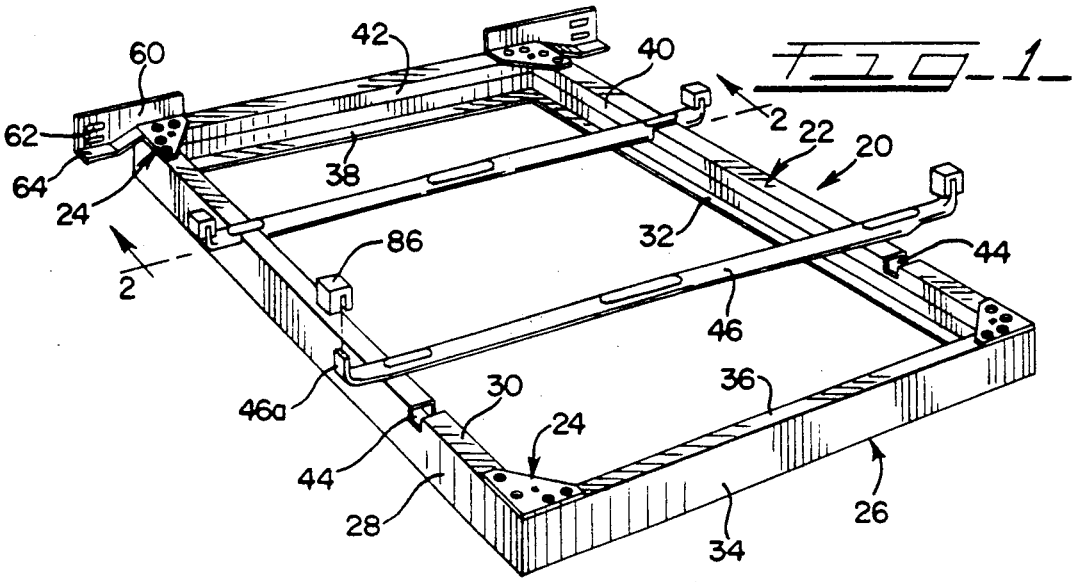
FIG. 1 is a partially exploded perspective view of a platform bed frame in accordance with the present invention.

While this invention is susceptible of embodiment in many different forms, there is shown in the drawings and herein will be described a preferred embodiment of the invention, with the understanding that the disclosure is to be considered as an exemplification of the principles of the invention and is not intended to limit the invention to the embodiments illustrated and described.

Referring now to the drawings, FIG. 1 shows a platform bed frame which, for purposes of convenience, is hereinafter referred to as a platform. The platform 20 includes side plates 22 that are in spaced relationship with one another and are interconnected by detachable securement means 24 to end plates 26 that extend perpendicularly between the side plates to form a generally rectangular platform. A mattress (not shown) is suitably disposed on the platform 20 in use.

The side plates 22 of the platform are parallel and have substantially the same dimensions. Each side plate has a substantially vertical wall portion 28 that has an upper edge and a lower edge. An upper horizontal portion 30 is integral with the upper edge of the wall portion 28 and extends inwardly from the wall portion towards the other side plate. A generally horizontal foot portion 32 is integral with the lower edge of the wall portion 28 and also extends inwardly from the wall portion towards the other side plate. The upper horizontal member 30 and foot portion 32 are substantially parallel to one another and together with the vertical wall portion 28 form a generally C-shaped section, with the foot portion 32 confronting the surface upon which the platform is situated.

The end plates 26 are also parallel and have substantially the same dimensions. Each end plate has a substantially vertical intermediate portion 34 that has an upper edge and a lower edge. A generally horizontal upper arm portion 36 is integral with the upper edge of the intermediate portion 34 and extends inwardly from the intermediate portion towards the other end plate. A generally horizontal lower leg portion 38 is integral with the lower edge of the intermediate portion 34 and also extends inwardly from the intermediate portion towards the other end plate. The upper arm portion 36 and lower leg portion 38 are substantially parallel to one another and together with the intermediate portion 34 form a generally C-shaped section, with the lower leg portion 38 confronting the surface upon which the platform is situated.

Figure 2:
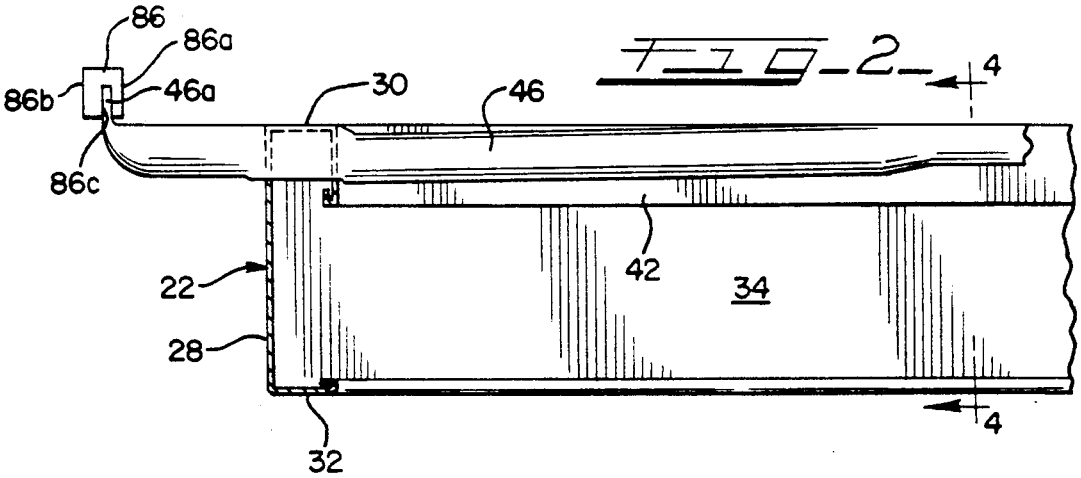
FIG. 2 is an enlarged fragmentary cross-sectional view taken along plane 2—2 in FIG. 1.

As shown in FIGS. 1 and 2, the upper horizontal member 30 and upper arm portion 36 each include an inner end, and the side plates 22 and end plates 26 each further include a generally vertical downwardly extending flange 40 and 42, respectively. Preferably, the flanges extend less than one-half the height of the vertical wall portion 28 and intermediate portion 34 and provide greater strength to the side plates and end plates. As shown, the lowermost edge of the flanges may be folded inwardly so that sharp edges of the side plates and end plates are not exposed. Similarly, the foot portion 32 and leg portion 38 have inner edges which preferably are folded over so that sharp edges of the side plates and end plates are not exposed.

The side plates 22 each have at least one transversely extending channel or notch 44 along the uppermost portion of the side plate. As shown in FIG. 1, the notches 44 are defined by cut-out portions along vertical wall portion 28, upper horizontal member 30 and flange 40. The notches 44 in each side plate are aligned with corresponding notches in the other side plate. At least one cross support member 46 extends between the side plates for supporting the mattress, and each cross support member is positioned within a pair of aligned notches.

The side plates 22 and end plates 26 are detachably secured together to form a generally rectangular platform. In order to accomplish this, the adjacent ends of each end plate and side plate are detachably secured together at two spaced-apart locations for firm securement.

The ends of each upper horizontal member 30 are secured to the adjacent ends of the upper arm portion 36 by securement means indicated generally at 24 in FIGS. 1 and 6–8. Such securement means preferably comprises a connecting bracket that is a generally flat plate having an exposed top major face 52 and a bottom major face 54. The plate is preferably in the shape of a right triangle and the lesser angles are both about 45°. The bracket 24 is formed with male projection portions 48 that are located to be received through and frictionally engage corresponding apertures 50 in the upper horizontal member 30 and the upper arm portion 36 when the upper ends of the side plates 22 and end plates 26 are positioned adjacent to one another. The adjacent ends of the upper horizontal member 30 and upper arm portion 36 are beveled and are at an angle of about 45° relative to the respective upper edges of vertical wall portion 28 and intermediate portion 34. The beveled edges preferably contact one another when the side plates and end plates are secured together.

To secure each side plate and end plate together, a bracket 24 is positioned with the male projection portions 48 engagingly received in a corresponding aperture 50, and the bottom major face 54 is in facing relationship with the upper horizontal member 30 of side plate 22 and the upper arm portion of end plate 26.

Figure 7:
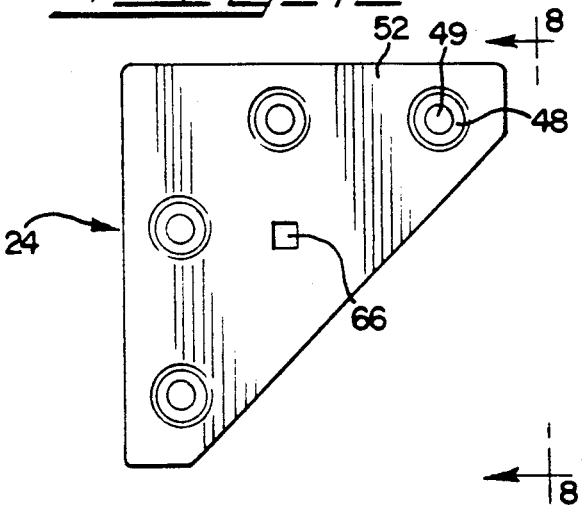
FIG. 7 is an enlarged top plan view of the connecting bracket.
Figure 8:
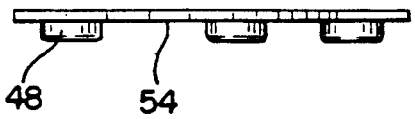
FIG. 8 is an elevation view of the connecting bracket taken along plane 8—8 in FIG. 7.

As best seen in FIGS. 7 and 8, the projection portions 48 are integrally formed so as to project outwardly in the downward direction from the bottom major surface of bracket 24. The projection portions are formed by embossed holes 49 punch formed in the bracket 24. The projection portions 48 correspond to the apertures 50 and have an outer diameter substantially the same as the diameter of the apertures so as to cause a press tight fit when they penetrate into and through the apertures 50. Although not specifically illustrated, it is anticipated that as the projection portions are press fit into tight engagement with the apertures 50, the bottom major surface of bracket 24 may be spaced a short distance from the upper horizontal member 30 and the upper arm portion 36. The outer edges of the projection portions 48 are formed with a reduced diameter to facilitate the receipt thereof into the apertures 50.

The second location where the adjacent ends of each end plate and side plate are detachably secured together is best illustrated in FIGS. 3–6, and comprises a second male member 56 on the lower leg portion 38 of the end plate 26 that engages a second aperture 58 that is defined at each end of the foot portion 32 of each side plate 22. The second male member 56 preferably consists of pin extending upwardly from each end of lower leg portion 38 of each plate 26 and the second aperture 58. The pin is receivable in the aperture and extends through the aperture, and the ends of the lower leg portion 38 and foot portion 32 are positioned in overlapping surface to surface to surface contact. As shown FIGS. 3 and 6, the end of the foot portion 32 overlies the end of the lower leg portion 38, and the end of the foot portion may be bent upwardly by an amount corresponding to the thickness of the leg portion so that the remaining portion of the foot portion and the entire length of the leg portion are available to confront the surface upon which the platform 20 is situated.

Figure 6:
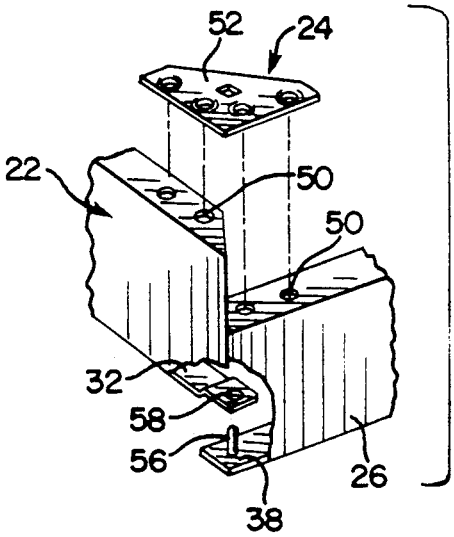
FIG. 6 is an exploded perspective view of the connector bracket and a portion of a side plate and end plate.

As best seen in FIG. 6, to connect the end plates and side plates, each end of the side plates is raised slightly and is then lowered so that the pins 56 in the lower leg portion 38 of the end plate are received in and engage the apertures 58 in the foot portion 32 of the side plate. This first step connects the bottom portions of the side plates and end plates and also performs a locating function to facilitate the second step—securing together the upper portions of the side plates and end plates.

The second step is performed by taking a bracket 24 and moving it downwardly so that one pair of projections 48 is received in the pair of apertures 50 in the upper arm portion 36 of the end plate and the other pair of projections 48 is received in the pair of apertures 50 in the upper horizontal member 30 of the side plate. Four plates are used—one at each corner of the platform where a side plate and end plate are adjacent to one another. There are two edges of bracket 24 which are at right angles to each other, and one of the edges overlies the upper edge of the vertical wall portion 28 of the side plates and the other overlies the upper edge of the intermediate portion 34 of the end plate.

The bracket 24 may include means for securing a headboard to that platform. Bracket 24 includes an upstanding wall portion 60 which is disposed generally vertically in relation to the floor and generally perpendicularly to the top major face 52 of the bracket. The wall portion 60 extends upwardly from the edge that overlies the upper edge of the intermediate portion 34, and extends outwardly beyond the edge of the bracket that overlies the upper edge of the vertical wall portion 28. Thus, the upstanding wall portion has a greater width than the top major face 52 of the bracket. The wall portion 60 of bracket 24 defines at least one horizontally extending slot 62 through which a screw can be inserted for securing a headboard to the bracket 24. The bracket may further include a flattened portion 64 which is perpendicular to and extends inwardly from the bottom edge of the upstanding wall portion. The flattened portion 64 also extends to the edge of top major face 52 which overlies the upper edge of the vertical wall portion 28. The flattened portion can provide support for the legs of the headboard. All portions of the bracket 24, including the plate in which top major face 52 is the upper surface, upstanding wall portion 260, and flattened portion 64, preferably are integral and may be formed from sheet metal.

Figure 3:
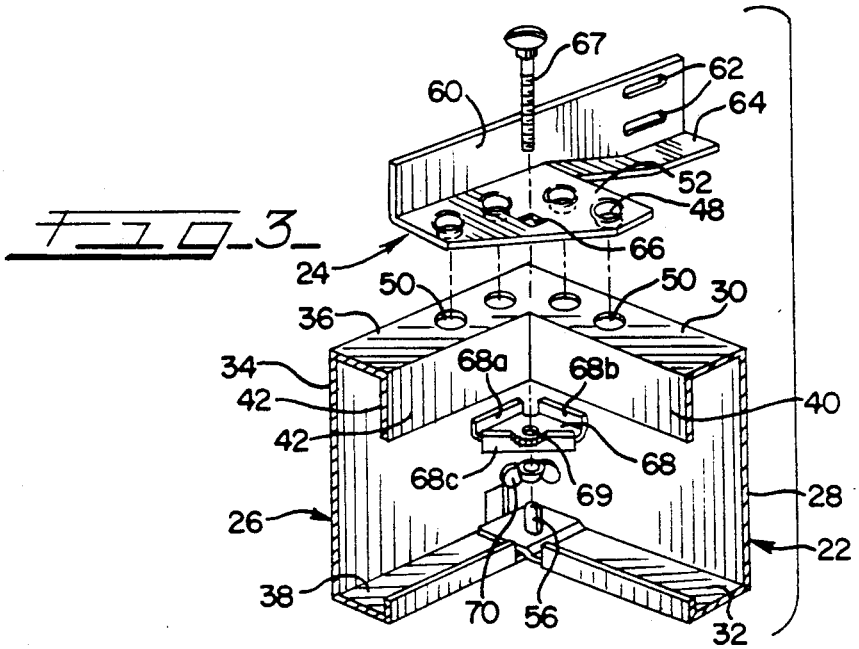
FIG. 3 is an exploded perspective view of the connecting bracket and a portion of a side plate and end plate.
Figure 4:
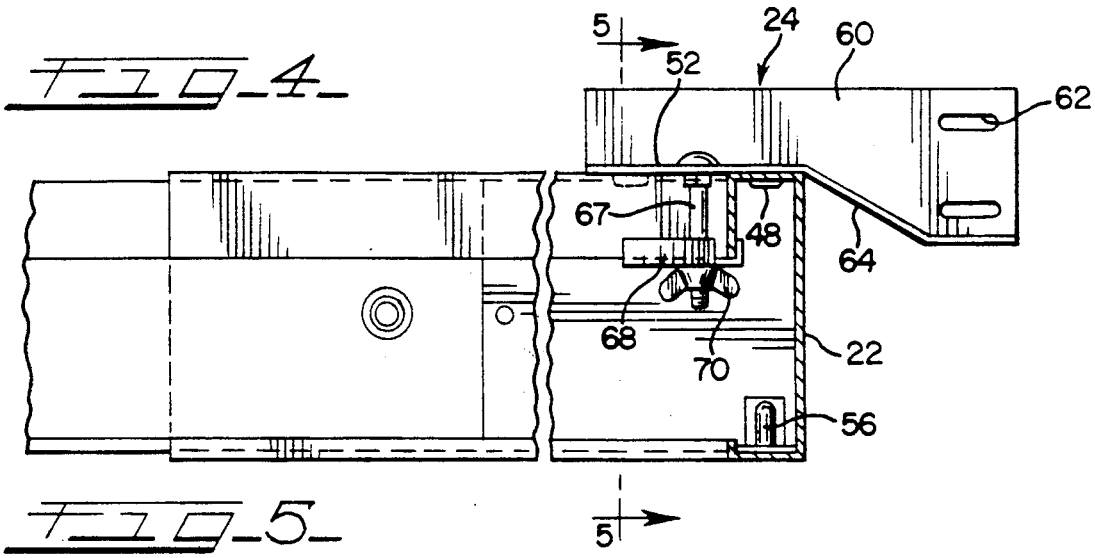
FIG. 4 is a fragmentary cross-sectional view taken along plane 4—4 in FIG. 2.
Figure 5:
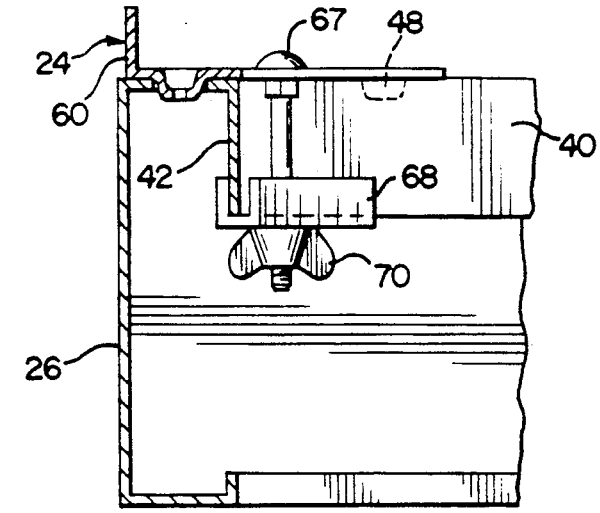
FIG. 5 is a fragmentary cross-sectional view taken along plane 5—5 in FIG. 4.

To provide additional support the portion of the bracket 24 having projection portions 48 defines a square aperture 66 through which a square neck carriage bolt 67 is receivable, as shown in FIGS. 3–5, with the square neck of the bolt 67 being restrained from turning by the sides of opening 66. A plate member 68, which may be generally triangular in shape and has upturned sides **68*a*, 68*b* and 68*c*, also defines an aperture 69 through which the bolt 67 is receivable. When the bolt 67 is extended through the apertures 66 and 69, a wing nut 70 is tightened until the upper surface of plate member 68 contacts the lower edges of flanges 40 and 42. The aperture 66 is positioned such that the bolt 67 is disposed inwardly of flanges 40 and 42 so that the bolt need not pass through either upper horizontal member 30 or upper arm portion 36. The plate 68 provides further strength for holding the side plate 22 and end plate 26 together in that side 68*a* engages the surface of flange 42 facing end plate 26 and side 68*b* engages the surface of flange 40 facing side plate 22, while side 68*c* is juxtaposed to and extends between the opposite surfaces of flanges 40 and 42**.

To limit lateral movement of the mattress relative to the platform, upwardly extending stop means is provided at each end of each cross support member. As shown in FIGS. 1 and 2, the stop means may compose an upwardly extending terminal portion **46*a* of the cross support member. Since there are frequently small variations (of about one-half inch) in the width of mattresses, the stop means may further include a block 86 which has a front end 86*a* and a back end 86*b* and female means positioned closer to one end than the other. The terminal position 46*a*** of the cross support member comprises male means which is receivable in the female means.

More specifically, the female means comprises a channel **86*c* positioned closer to the front end of the block 86 than to the back end. The block 86 is positioned on the terminal portion 46*a* of the cross support member with the front end 86***a* facing inwardly to accommodate a mattress of a first width (FIG. 2), and is reversible to the position shown in FIG. 5 to accommodate a mattress of a second width which is narrower, and may be removed so that the terminal portion 46*a* functions as the stop means to accommodate a mattress of a third width which is wider.

If a mattress and box spring combination is used on the platform, the box spring may be placed directly on the platform with its frame being supported on the generally coplanar surfaces defined by upper horizontal members 30 of side plates 12 and also on upper arm portions 36. Additional support may be provided by the cross support members, as shown in FIGS. 1 and 2. Thus, the platform of the present invention may support an ordinary box spring/mattress combination that is commonly used with Hollywood bed frames. This provides the user with the same degree of sleeping comfort when using a platform bed in accordance with the present invention as is commonly available using Hollywood bed frames. If an ordinary mattress is used without a box spring, it may be supported on a flat board or alternatively on a plurality of cross support members.

The connecting bracket 24 fabricated in accordance with the invention reduces material costs and simplifies manufacture and assembly of the securement means of the platform. Further, the press tight fit achieved between the bracket 24 and the end plate and side plate form a rigid and secure joint.

What is claimed is:

1. A platform bed frame for supporting mattress means in spaced relationship to a floor, comprising:

a pair of spaced parallel side plates, each side plate having substantially the same dimensions and including a wall portion having an upper edge and a lower edge and disposed generally vertically in relation to the floor, an upper horizontal member integral with the upper edge of the wall portion, said upper horizontal member having a given thickness dimension, and a generally horizontal foot portion integral with the lower edge of the wall portion for confronting the surface upon which the platform is situated;

a pair of longitudinally spaced end plates extending substantially transversely between said side plates, each end plate having substantially the same dimensions and including an intermediate portion having an upper edge and a lower edge and disposed generally vertically in relation to the floor, a generally horizontal upper arm portion integral with the upper edge of the intermediate portion, said upper arm portion having a given thickness dimension, and a generally horizontal lower leg portion integral with the lower edge of the intermediate portion for confronting the surface upon which said platform is situated; and means for detachably securing each of said side plates to form a generally rectangular platform and comprising a connecting bracket having projection portions integrally formed along one face thereof, said projection portions extending outwardly from said one face by a dimension greater than the given thickness dimensions of said upper horizontal member and said upper arm portion, the ends of said side plates and end plates being provided with apertures formed therethrough, said projection portions being larger in cross-sectional dimension than its corresponding aperture so as to be in press fit engagement with such aperture when the ends of said side plates and end plates are positioned adjacent to one another and said connecting bracket is positioned with its said major face disposed in facing relationship with the upper horizontal member of the side plate and the horizontal upper arm portion of the end plate.

2. A platform bed frame as set forth in claim 1 wherein apertures are punched through said connecting bracket so as to form said projection portions.

3. A platform bed frame as set forth in claim 1 wherein the outer edges of said projection portions are formed with a reduced diameter to facilitate the receipt thereof into said apertures provided in said side plates and end plates.

4. A platform bed frame as set forth in claim 1 wherein said upper horizontal member and said lower horizontal member extend inwardly from said wall portion and said upper arm portion and said lower leg portion extend inwardly from said intermediate portion.

5. A platform bed frame as set forth in claim 4 wherein the ends of said lower horizontal members are positioned in overlapping surface to surface contact with the ends of said foot portions.

6. A platform bed frame as set forth in claim 5 wherein said securing means includes a pin extending upwardly from the lowermost of said overlapping lower horizontal members and foot portions and an aperture in the uppermost of said overlapping lower horizontal members and foot portions, each pin being receivable in one of said apertures.

7. A platform bed frame as set forth in claim 1 wherein at least one notch is formed in the uppermost portions of each side plate, each notch in each side plate being aligned with a notch in the other side plate, and wherein at least one cross support member extends between said side plates and is positioned within a pair of aligned notches for supporting said mattress means.

8. A platform bed frame as set forth in claim 6 wherein said upper horizontal members, said upper arm portions and said at least one cross support member together provide support for said mattress means.

9. A platform bed frame as defined in claim 1 wherein said upper horizontal members and said horizontal upper arm portions terminate in an inner edge, flanges extend downwardly from the inner edge of said upper horizontal members and said horizontal upper arm portions, said flanges having a lowermost edge, a plate having an upper surface that contacts said lowermost edge of at least two of said flanges, said plate and said connecting bracket having an aperture formed therein in vertical alignment with one another, a bolt extending through said apertures in said connecting bracket and said plate, said bolt having a head that engages a surface of said connecting bracket and a nut means receivable on said bolt and in engagement with said plate to provide additional securement between said side plates and said end plates.

* * * * *